US008387285B2

(12) United States Patent
Hartveld

(10) Patent No.: US 8,387,285 B2
(45) Date of Patent: Mar. 5, 2013

(54) FOOTWEAR WITH SOLE FORCE DISTRIBUTION AND SENSE ENHANCEMENT

(76) Inventor: Adri Hartveld, Newcastle-under-Lyme (GB)

( * ) Notice: Subject to any disclaimer, the term of this patent is extended or adjusted under 35 U.S.C. 154(b) by 820 days.

(21) Appl. No.: 12/065,312

(22) PCT Filed: Sep. 4, 2006

(86) PCT No.: PCT/GB2006/003270

§ 371 (c)(1),
(2), (4) Date: Jul. 23, 2008

(87) PCT Pub. No.: WO2007/026175

PCT Pub. Date: Mar. 8, 2007

(65) Prior Publication Data

US 2009/0119951 A1 May 14, 2009

(30) Foreign Application Priority Data

Sep. 2, 2005 (GB) ..... 0517867.8
Mar. 1, 2006 (GB) ..... 0604058.8
Mar. 27, 2006 (GB) ..... 0606051.1

(51) Int. Cl.
*A43B 21/00* (2006.01)
*A43B 13/14* (2006.01)

(52) U.S. Cl. ..... 36/105; 36/103; 36/102; 36/25 R

(58) Field of Classification Search ..... 36/105, 36/103, 102, 25 R, 30 R, 31
See application file for complete search history.

(56) References Cited

U.S. PATENT DOCUMENTS

| | | | | | |
|---|---|---|---|---|---|
| 2,758,394 | A | * | 8/1956 | Whitlock | 36/129 |
| 4,040,192 | A | * | 8/1977 | Perez | 36/108 |
| 4,187,623 | A | * | 2/1980 | Dassler | 36/129 |
| 4,241,523 | A | | 12/1980 | Daswick | |
| 4,259,792 | A | * | 4/1981 | Halberstadt | 36/28 |
| 4,348,821 | A | | 9/1982 | Daswick | |
| 4,551,930 | A | | 11/1985 | Graham et al. | |
| 4,656,760 | A | | 4/1987 | Tonkel et al. | |
| 4,766,679 | A | | 8/1988 | Bender | |
| 4,949,476 | A | * | 8/1990 | Anderie | 36/129 |
| 5,694,706 | A | * | 12/1997 | Penka | 36/103 |
| D399,995 | S | * | 10/1998 | Park | D2/954 |
| 6,115,941 | A | | 9/2000 | Ellis, III | |
| 6,247,249 | B1 | * | 6/2001 | Lindqvist | 36/28 |
| 6,341,432 | B1 | | 1/2002 | Muller | |

FOREIGN PATENT DOCUMENTS

| | | | |
|---|---|---|---|
| DE | 3347343 | | 7/1985 |
| DE | 3904645 | | 8/1990 |
| EP | 458174 | A1 * | 11/1991 |
| EP | 0838169 | | 4/1998 |
| EP | 1002473 | A1 * | 5/2000 |

(Continued)

*Primary Examiner* — Ted Kavanaugh

(57) ABSTRACT

According to the present invention there is provided a sports shoe (10) having an upper part (12) configured to receive the foot (14) of a wearer and a sole arrangement (16) which is inclined so as to reduce in height in a forwards direction, wherein the sole arrangement (16) includes a rigid portion (40) and a compressible portion (28) where the rigid portion (40) is thinner than the compressible portion (28) and, in use, is provided between the compressible portion (28) and the foot (14) of the wearer, wherein further the rigid portion (40), in use, is provided beneath the heel (22), lateral aspect of the mid foot, the fifth metatarsal bone (52) and the fifth metatarsal joint (34) of the foot (14) of the wearer.

1 Claim, 4 Drawing Sheets

FOREIGN PATENT DOCUMENTS

| | | |
|---|---|---|
| EP | 1025770 | 8/2000 |
| EP | 1219193 | 7/2002 |
| EP | 1254610 | 11/2002 |
| FR | 2658396 | 8/1991 |
| WO | WO 8103414 | 12/1981 |
| WO | WO 9613995 | 5/1996 |
| WO | WO9808404 | 3/1998 |
| WO | WO 03/088777 | * 10/2003 |

* cited by examiner

FOOTWEAR WITH SOLE FORCE DISTRIBUTION AND SENSE ENHANCEMENT

The present invention relates to a sports shoe and particularly to a sports shoe for use in connection with activities which involve running and jumping.

When running or jumping, the human body experiences a sudden increase in vertical ground reaction force, commonly termed a shock or impact loading, when a foot comes into contact with the ground. The repeated application of such loads to the human body during running or jumping activities are a major contribution to musculoskeletal injuries. The repeated loads can cause the breakdown of components of the musculoskeletal system including joints, ligaments, tendons, muscles and bones.

In order to prevent excessive strain during running and jumping activities, and therefore prevent injuries, the leg muscles of the human body act to stabilise the hip, knee, ankle and foot joints. The effectiveness of the leg muscles in terms of control, speed and strength is highly dependent upon the information received by the muscles from the brain via the spinal cord. This information is generated by sensory organs situated in the muscles, ligaments and skin of the leg when it comes into contact with the ground. Through both feed back and feed forward systems present within the body, the appropriate muscles within the leg exert the correct tension at the right time to prevent excessive lateral twist and excessive loading on the body.

During running and jumping activities, the shock on the body is reduced when the time between the outer sole of the shoe contacting the ground and the calcaneus (heel bone) coming to a standstill is increased. In conventional sports shoes used for running and jumping activities, this time is quite brief as the material of the shoe sole intermediate the outer sole and the foot of the wearer, hereinafter referred to as the mid sole, is typically of a medium density and limited thickness. The use of a lower density material for the mid sole would not increase the relevant time noted above as the impact forces experienced in running and jumping would fully compress the mid sole material and the shoe would "bottom out". With the conventional medium density material of the mid sole, the thickness of the sole is limited by the weight of the sole. It will be appreciated that a thick sole will be heavy and would impede the running action of the wearer.

It has been observed that conventional running shoes have a negative effect on the natural shock absorbing and stabilising responses of the leg muscles of a wearer. Typically the material of the upper sole of the shoe, which is to say the part of the sole which is close to the foot of the wearer, is not hard and as such, the wearer is less able to perceive the vertical and transverse forces experienced by the body. With this reduction in propriocepsis, the sensory-motor feedback and feed forward mechanisms of the body cannot work as well.

According to the present invention there is provided a sports shoe having an upper part configured to receive the foot of a wearer and a sole arrangement which reduces in height in a forwards direction, wherein the sole arrangement includes a substantially incompressible rigid portion and a compressible portion where, in use, the rigid portion is thinner than the compressible portion and is provided between the compressible portion and the foot of the wearer, wherein further the rigid portion, in use, is provided beneath the heel, lateral aspect of the mid foot, the fifth metatarsal bone and the fifth metatarsal joint of the foot of the wearer.

A shoe constructed in the manner described above provides improved shock absorption as the downward force exerted by the wearer when running or jumping is distributed across the compressible portion. As the rigid portion of the sole arrangement does not extend beneath the foot of the wearer entirely, then the sole arrangement does not impede the natural movement of pronation, during the middle part of the stance phase of walking, running and like activities. The sole arrangement furthermore does not impede the flexing of the metatarsal-phalangeal joints required for effective push off during the stance phase of walking, running or other activities.

In an alternative embodiment, the rigid portion may extend at least partially beneath the fourth metatarsal bone and the fourth metatarsal joint of the foot of the wearer. In such an embodiment, the rigid portion may extend fully beneath the fourth metatarsal bone and the fourth metatarsal joint of the foot of the wearer. In either embodiment the rigid member does not extend beneath the navicular bone, the first cuniform bone, the first, second and third metatarsal bones, the first, second and third metatarsal joints and the phalangeal bones of the first second and third toes of the foot of the wearer.

In a preferred embodiment the rigid portion comprises a broader posterior portion and a narrower anterior portion. The anterior portion preferably extends from one side of the posterior portion such that the rigid portion, in plan, has a shape which is similar to a "d" or inverted "p" shape. The rigid portion of the sole arrangement may defined by a rigid member which is located on the compressible portion. In such an embodiment the rigid member may be received in a complementarily shaped recess of the compressible portion. Where the rigid member is located in such a recess, the depth of the recess may be such that the upper face of the rigid member is aligned with the upper face of compressible portion surrounding the recess.

In an alternative embodiment, the rigid portion is incorporated into a member which overlies the compressible portion of the sole arrangement. The rigid portion may thus be incorporated into an insole which conforms either fully or partially to the interior shape of the upper part of the shoe. The overlying member may comprise said rigid portion and a less rigid portion. The less rigid portion may be substantially less rigid than the rigid portion, for example comprising a cushion type compressible insole. Alternatively, the less rigid portion may be only slightly less rigid than the rigid portion. The overlying member may formed from a fibre reinforced composite material and the orientation of fibres within the composite material define the rigid and less rigid portions. Preferably, said less rigid portion is provided beneath more medial aspects of the foot of the wearer than said rigid portion.

The rigid portion may include a downwardly depending protrusion arranged so as to contact the ground as a result of over compression of the compressible portion of the sole arrangement. Upon contact with the ground, the protrusion may provide an indication to the wearer of the shoe that contact has been made. This indication may be physical, for example a force or sensation transmitted to the foot of the wearer through the rigid portion. Alternatively, or in addition to the physical indication, there may be provided an audible indication arising from the contact of the protrusion with the ground. The ground engageable protrusion may be located in the rear third of the sole arrangement.

The rigid portion may includes one or more surface formations adapted to increase the rigidity thereof. The or each surface formation may comprise a rib, groove or the like. Preferably, the surface formations are provided on the underside of the rigid portion, which is to say the side of the rigid portion which faces the compressible portion of the sole arrangement. The or each surface formation may extend in a substantially longitudinal direction with respect to the shoe, which is to say in a direction substantially aligned with the anterior to posterior axis or the shoe. At least a portion of the upper surface of the rigid portion may be shaped so as to accommodate the shape of the heel of a wearer. For example, the upper surface may be cupped so as to accommodate the shape of the heel of a wearer. The rigid portion may further be shaped so as to conform to the shape of other features of the wearer's foot. For example, a region of the rigid portion may be curved in a convex manner with respect to the wearer's foot so as to conform to the shape of the arch of the wearer's foot between the heel of the foot and the ball of the foot.

The sole arrangement of the shoe may be heelless. The rigid portion may have a ShoreA hardness value of greater than 75, while the compressible portion may have a ShoreA hardness value of less than 40.

The ground facing side of the sole arrangement may be provided with a recess which, at rest, is not ground engaging. The term "at rest" may encompass the situation where the shoe is being worn but the wearer is standing still. The term "at rest" may also encompass the situation where the shoe is not being worn and is resting sole down on a surface. The recess may be configures such that it disappears as a result of compression of the sole arrangement during a foot strike event. The recess may be provided in a mid part of the ground facing side of the sole arrangement.

The inclination of the sole arrangement may be such that, on a flat surface with no pressure applied, the sole arrangement has a gradient between the area of the heel bone and the area of the ball of the foot which is 1:8 or less but which decreases due to compression of the sole arrangement when a wearer applies a downwards force to the sole arrangement when running or jumping. The inclination of the sole arrangement is greater than that for a conventional running shoe. The uncompressed gradient of the sole arrangement may be in the region of between 1:7 and 1:6. Alternatively, the uncompressed gradient of the sole arrangement may be between 1:6 and 1:5. In yet a further embodiment, the uncompressed gradient of the sole arrangement may be between 1:5 and 1:4. Alternatively, the uncompressed gradient of the sole arrangement may be between 1:4 and 1:3. Alternatively, the uncompressed gradient of the sole arrangement is between 1:3 and 1:2. The sole arrangement may be compressible to between 10% to 50% of its original thickness when subjected to a rapid, intermittent compressive force of between 600 to 6000 Newtons.

In yet a further embodiment of the present invention, the shoe may be provided with an upper sole member which extends over the compressible portion of the sole arrangement and under the calcaneus bone, cuboid bone, metatarsal bones and metatarsal joints of the wearer. In such an embodiment the upper sole member is provided with a rigid region which lies below the calcaneus, cuboid and fifth metatarsal bones of the wearer. The rigid region is configured so as to be substantially inflexible in the longitudinal direction of the shoe, but permits rotational and transverse flexibility of the upper sole member to permit pronation of the foot of the wearer. The upper sole member may optionally extend below the navicular bone and/or cuniform bones and/or phalangeal bones on the wearer.

According to a further aspect of the invention there is provided an insert for a sports shoe, the insert being adapted to lie, in use, between a compressible portion of the sole arrangement of a sports shoe and the foot of a wearer of the shoe, the insert including a rigid portion which is thinner than the compressible portion and, in use, is shaped so as to lie beneath the heel, lateral aspect of the mid foot, the fifth metatarsal bone and the fifth metatarsal joint of the foot of the wearer of the sports shoe. The rigid portion may fully comprise the insert. Alternatively, the rigid portion may be incorporated into the insert such that portions of the insert extend beyond the bounds of the rigid portion.

Further features of the invention are described in relation to embodiments of the present invention described with reference to the accompanying drawings in which.

Figure 1:
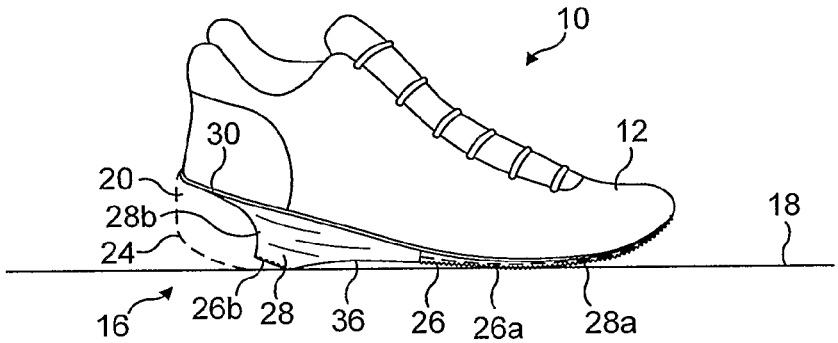
FIG. 1 shows a side view of a sports shoe according to an embodiment of the present invention.

Referring firstly to FIGS. 1 to 7 there is shows a sports shoe generally designated 10. The shoe comprises an upper part 12 within which a wearer's foot 14 is received, and a sole generally designated 16. The sole is conventionally located on the underside of the upper part 12 such that, in use, it is orientated between the wearer's foot 14 and the ground 18. In the embodiments shown the shoe 10 is illustrated in a "heel-less" configuration, which is to say that a recess 20 is provided in the sole in the region below the posterior portion of calcaneus or heel bone 22 of the wearer's foot 14. In an alternative embodiment, the shoe sole 16 may be provided with a heel as illustrated by broken line 24 in FIG. 1.

Figure 2:
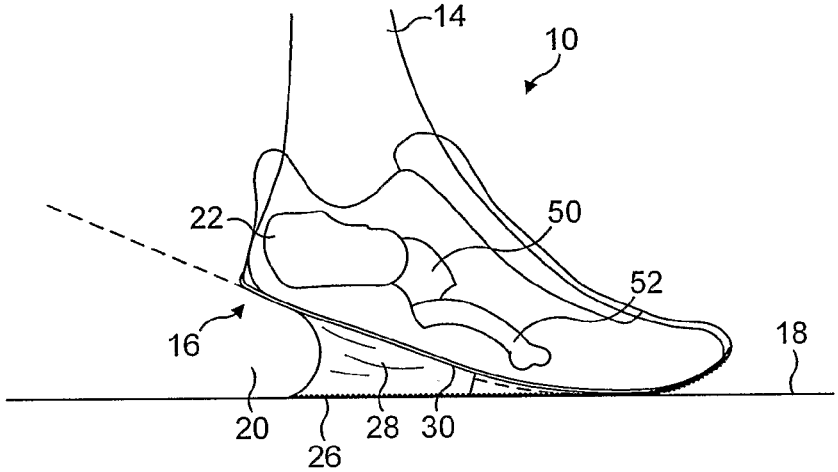
FIG. 2 shows a partially cutaway view of the shoe of FIG. 1 including the outline of a wearer's foot and selected bones of the wearer's foot.
Figure 3:
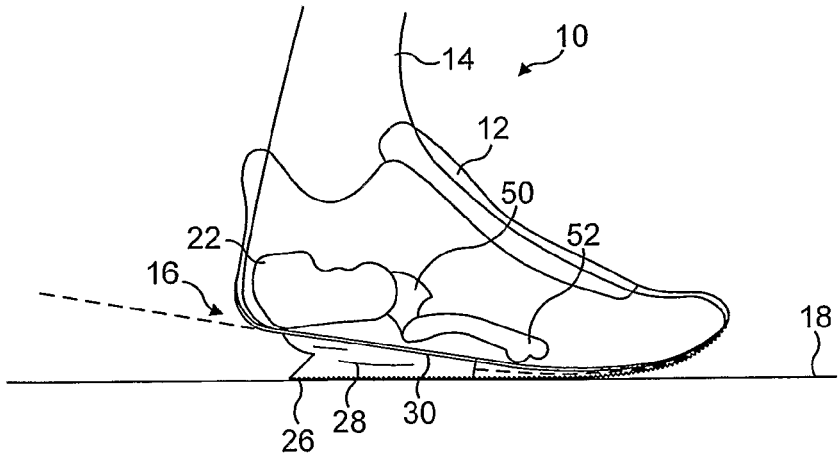
FIG. 3 shows a similar view of the shoe and wearer's foot to FIG. 2 with the mid sole compressed.
Figure 4:
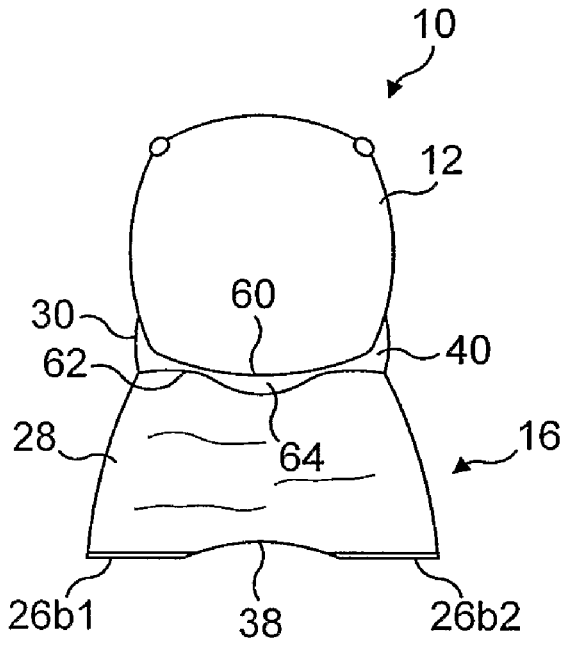
FIG. 4 shows a rear view of a cross-section of the shoe of FIGS. 1 to 3.
Figure 6:
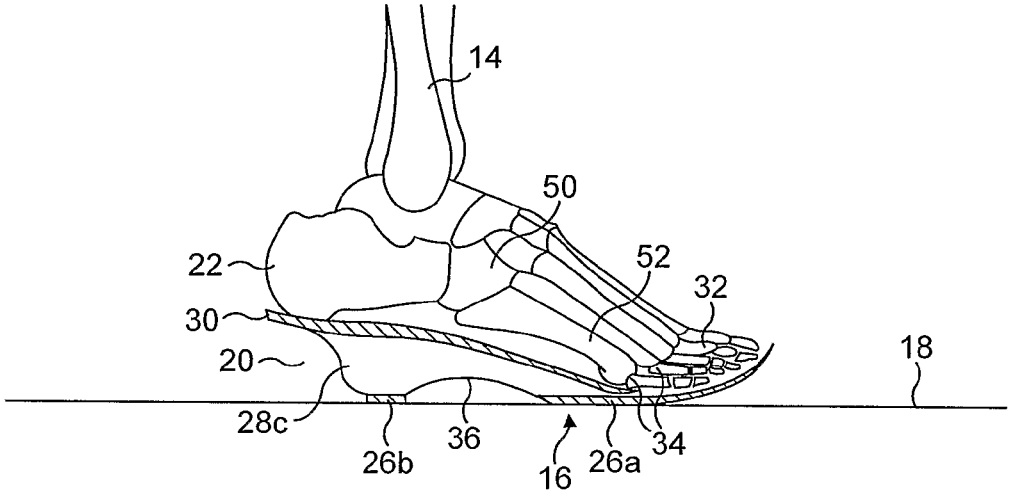
FIG. 6 shows a side view of shoe sole constructed in accordance with the present invention together with the skeletal structure of a wearer's foot.
Figure 8:
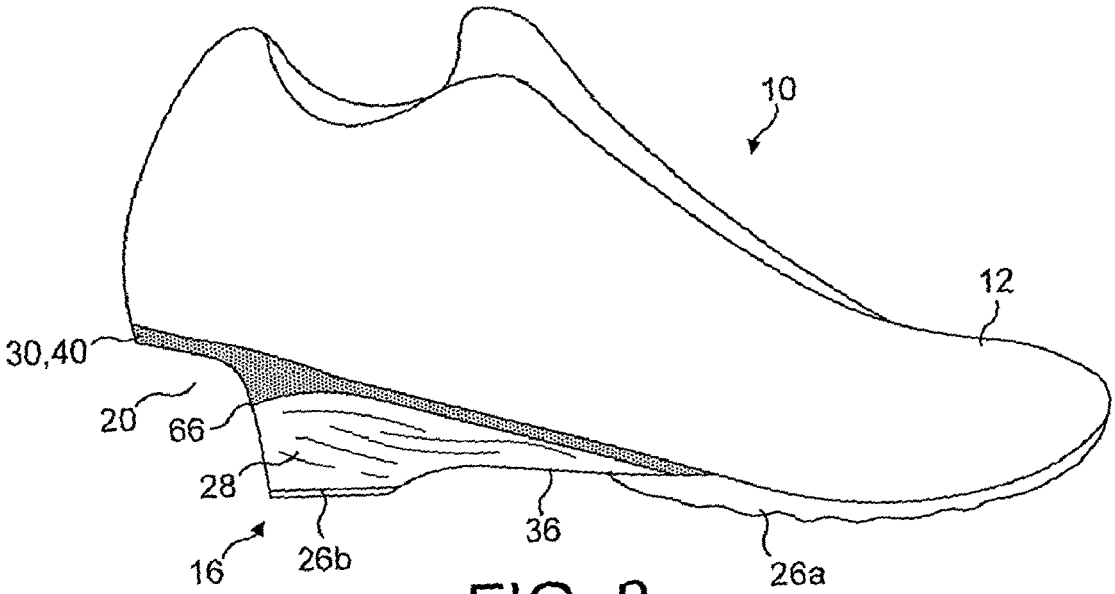
FIG. 8 shows a side view of a sports shoe according to an alternative embodiment of the present invention.

The sole 16 comprises an outer or lower sole 26, a mid sole 28 and an upper sole 30. As can be readily seen from the drawings, the upper sole 30 is of a generally uniform thickness and is thinner than the mid sole 28. The outer sole 26, in use, is ground engaging and as such may be configured appropriately to impart the required grip properties with the ground 18. Typically, the outer sole may be textured and/or provided with projections or grooves. The outer sole 26 is typically manufactured from a plastics material such as polyurethane. The outer sole 26 may extend fully over the underside of the sole 16 (FIGS. 2 and 3). Alternatively, the outer sole 26 may be configured so as to provide anterior and posterior portions 26*a*,26*b* (FIGS. 1, 6 and 8.) In such an embodiment, the anterior portion of the outer sole 26*a* is provided in the region of the phalangeal bones 32 and metatarsal joints 34 of the wearer's foot 14, while the posterior portion of the outer sole 26*b* is provided in the region beneath the cuboid bone 50. As can be seen from FIG. 4, the posterior portion 26*b* may be bifurcated into laterally opposed portions 26*b*1 and 26*b*2.

In cross-section, the mid sole 28 is essentially wedge shaped which reduces in thickness in the direction of the toes of the wearer so as to incline the upper part 12 of the shoe 10 in a forwards direction when no weight is applied to the shoe 10. In order to accommodate the anterior and posterior 26*a*, 26*b* outer sole configuration described above, the mid sole 28 may be provided with a recess 36 in the mid-part thereof. A further recess 38 may be provided in the rear portion of the mid sole 28 to accommodate the above described bifurcated outer sole posterior portion 26*b*1,26*b*2. The mid sole 28 may be of uniform mechanical properties, for example density, over its entire extent. Alternatively, the mid sole 28 may be configured so as to have differing mechanical properties over it's extent. For example, a fore portion 28*a* of the mid sole 28 may have a higher density than a rear portion 28*b* of the mid sole 28 so as to enhance the effectiveness of the pushing off of the ball of the foot 14.

Referring now to the upper sole 30, this includes a substantially rigid member 40. The upper sole 30 may be defined only by the rigid member 40. In such an embodiment, the rigid member 40 may be received in an appropriately configured recess or cut-out of the mid sole 28. The rigid member 40 may be positively retained in said recess, for example by adhesive. In an alternative embodiment, the rigid member 40 may be associated with or incorporated into an insole which is fittable to the interior of the shoe upper 12. In such an embodiment, the rigid member 40 may be connected to a less rigid, i.e. more flexible, member 42 which together correspond to an interior shape of the shoe upper. In yet a further embodiment, the rigid member 40 may extend fully below the foot 14 of the wearer and may be provided with areas of differing rigidity. For example, there may be provided a substantially inflexible portion to the rigid member in the area below the calcaneus 22, cuboid bone 50 and fifth metatarsal bone 52. The remainder of the rigid member 40 may be less rigid to permit a desired degree of transverse and rotational flexibility so as to allow pronation of the ankle and foot and flexion of the metatarsal phalangeal joints. The areas of differing rigidity may be provided as a result of the construction of the rigid member 40. For example, where the rigid member 40 is manufactured from a fibre reinforced composite material, the substantially inflexible portion may be realised by the directional positioning of the fibres.

In use, the rigid member 40 may be in direct contact with the foot 14 of the wearer. Alternatively, the rigid member 40 may be provided with a covering such as, for example, a liner of the shoe upper 12.

Figure 7:
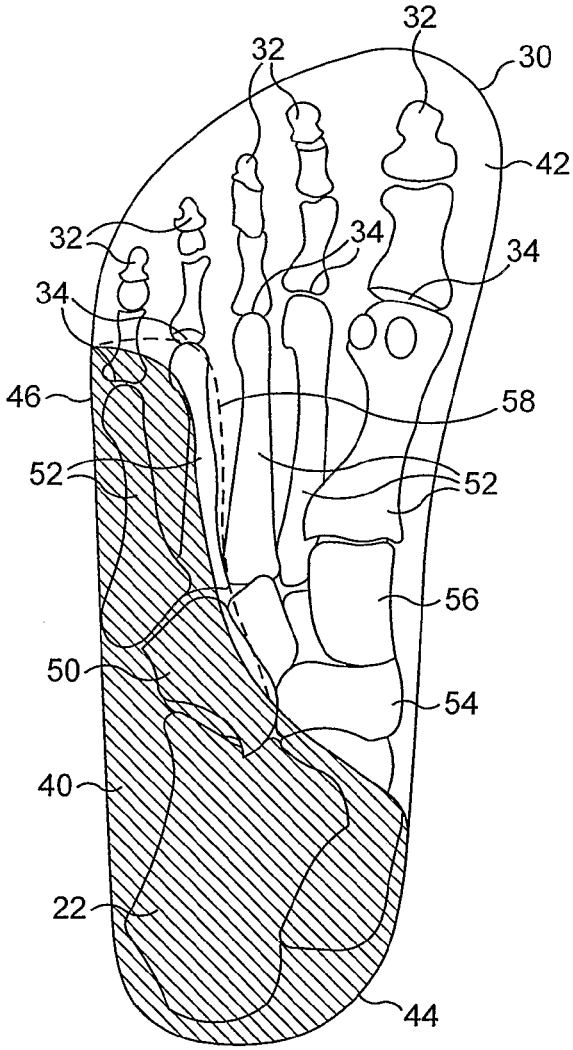
FIG. 7 is a bottom plan view of the upper sole of the shoe sole and the skeletal structure of the wearers foot.

Referring now to FIG. 7, the rigid member 40 comprises a posterior portion 44 and an anteriorly extending portion 46. In one embodiment, the posterior portion 44 is positioned below the calcaneus 22, while the anteriorly extending portion 46 is positioned below the lateral aspect of the mid foot, which is to say the cuboid bone 50, fifth metatarsal bone 52, and fifth metatarsal joint 34, and the head of the phalangeal bones 32 of the fifth toe. It will be appreciated that the rigid member is broader in the posterior portion 44 and narrower in the anterior portion 46. In the above described embodiment, the rigid member 40 is shaped so as not to lie below the navicular bone 54, nor the first cuniform bone 56 or the first, second and third metatarsal bones 52, first, second and third metatarsal joints 34 and phalangeal bones 32 of the first second and third toes. It will be noted that the rigid member 40 extends partially under the fourth metatarsal bone 52 and fourth metatarsal joint 34. In an alternative embodiment, the rigid member 40 may extend fully below the fourth metatarsal bone 52 and fourth metatarsal joint 34 as indicated by broken line 58, while remaining clear of the navicular bone 54, the first cuniform bone 56, the first, second and third metatarsal bones 52, the first, second and third metatarsal joints 34 and the phalangeal bones 32 of the first second and third toes. It will be understood that the bones not supported by the rigid member 40 are supported either by the mid sole 28 or the flexible member 42 of the upper sole 30.

Figure 5:
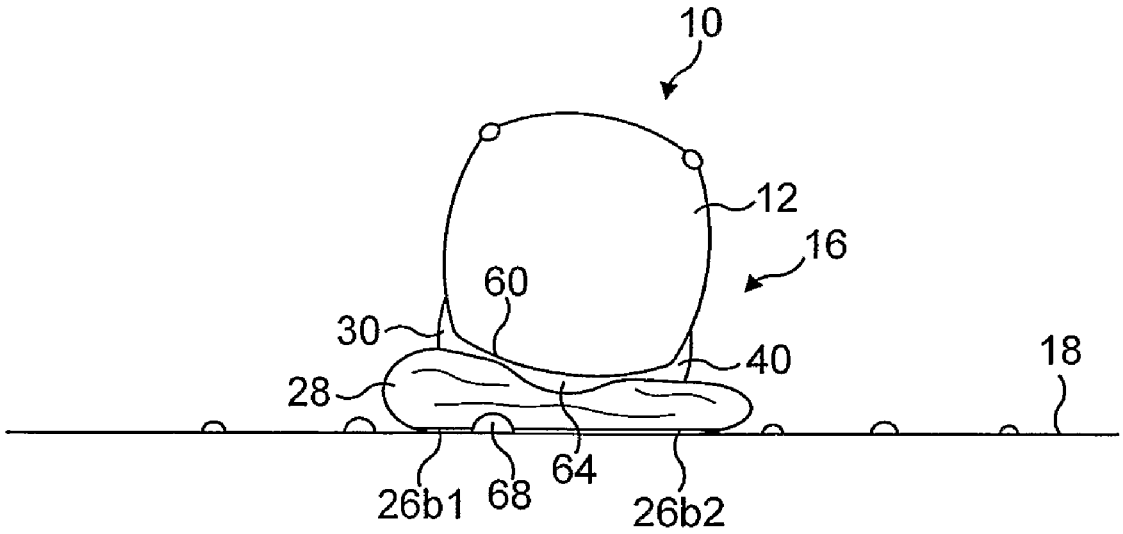
FIG. 5 shows a rear view of a cross-section of the shoe of FIGS. 1 to 3 with the mid sole compressed.

The rigid member 40 may be flat or contoured so as to conform to the shape of the wearer's foot 14 below which it is situated. As can be seen from FIGS. 5 and 6, the upper surface 60 of the rigid member 40 may be concave so as to accommodate the shape of a wearer's heel. The lower surface 62 of the rigid member, which is to say the surface 62 which faces the mid sole 28 may be ribbed, corrugated, ridged or other wise textured so as to enhance the rigidity of the rigid member 40. The rigid member 40 shown in FIGS. 5 and 6 is provided with a substantially centrally positioned rib 64 which extends in anterior to posterior direction.

The mid sole 28 is manufactured from a resiliently compressible material. The material chosen for the mid sole 28 will have a density which is less than that of the rigid member 40 of the upper sole 30. Preferably, the material of the mid sole may have a ShoreA hardness value of less than 40. The material of the mid sole may be a vinyl acetate material.

The rigid member 40 of the upper sole 30 is manufactured from a substantially incompressible material. The material chosen for the rigid member will have a density which is greater than that of the mid sole 28. Preferably, the material of the rigid may have a ShoreA hardness value of greater than 75. The material of the rigid member may for example comprise a composite material such as an organic fibre reinforced composite, a bio composite including hemp or flax fibres or a fibre reinforced thermoplastic.

The materials of the sole 16, in combination, preferably provide a sole which is able to compress to between 10% to 50% of its original thickness when subjected to the application of a compressive force in the region of 600 to 6000 Newtons.

In use and during foot strikes, the immediate shock is dissipated across the rigid member 40, which results in a lower initial force under the foot compared to that experienced with conventional running shoes. The force is distributed over a relatively larger part of the foot 14 and thereby serves to reduce the occurrence of injuries which tend to be caused by localised high forces and/or sudden increases in force. As the foot 14 of the wearer is in close contact with the rigid member 40, the body and mind of the wearer maintain a better sense of position and perception of stress than in conjunction with conventional running shoes. A sudden change in the position of the wearer can be quickly perceived and thereby provoke an appropriate response from the leg muscles which stabilise the user's body and therefore prevent excessive twisting. The perception of stress by the body is improved at the bottom or underside of the foot 14. The body thus responds better to the application of potentially injurious forces thereto by improved leg muscle response.

The wedge like nature of the mid sole 28 which inclines the foot 14 of the user in a forwards direction is also highly advantageous. The mid sole 28 may be configured so as to compress to a close to flat configuration as shown in FIG. 3.

The wedge like nature of the mid sole 20 ensures that, with no downward force applied to the shoe 10, the calcaneus 22 is supported at a greater height off the ground 18 when compared to conventional running shoes. Accordingly, the calcaneus 22 is further away from the ground at the very start of a foot strike. During a foot strike event, the calf muscles of the wearer decelerate the calcaneus 22 over a longer period of time as the mid sole 28 is compressed. This results in a less rapid increase in vertical ground reaction force experienced by the foot 14 of the wearer. The lowering of such impact forces reduce the possibility of injury. Over time, the inclined nature of the mid sole 28 encourages and trains the wearer to strike the ground with their foot 14 in the region below the cuboid 50 or the fifth metatarsal bone 52.

Figure 9:
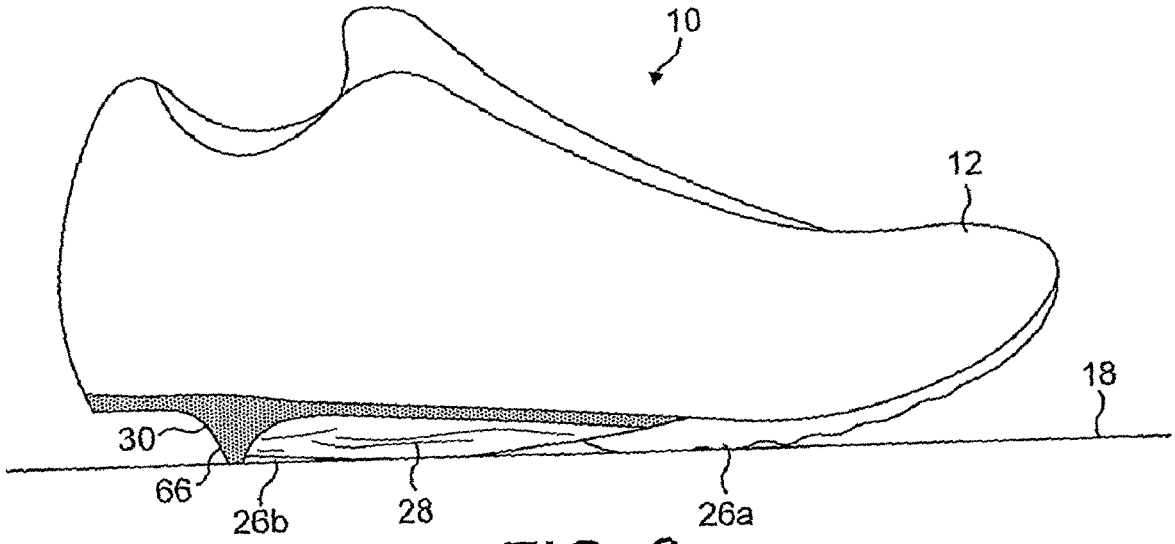
FIG. 9 shows a side view of the sports shoe of FIG. 8 with the mid sole compressed.

Referring now to FIGS. 8 and 9 there is shown a further embodiment of a shoe, generally designated 10. Features common to the embodiment described with reference to FIGS. 1 to 7 are identified with like reference numerals. The shoe 10 differs in that the rigid member 40 is provided with a downwardly depending protrusion 66. The protrusion 66 is provided in the region of the rear third of the sole 16 and is arranged such that it is able to contact the ground, as shown in FIG. 9, if the wearer applies a high, rapidly increasing force to the ground 18 on the rear third of the sole 16. Such force may typically be experienced when the wearer is running incorrectly and striking the ground with their heel. Should the wearer step in this manner, and the protrusion 66 comes into contact with the ground 18, a reactive force will be applied to the rigid member 40 in the region of the calcaneus 22. This will be perceived by the user and while not being painful, will provide a tactile indication that they need to modify their gait so as not to heel strike. The protrusion 66 may also be configured so as to provide an audible indication to the wearer, such as a click, as it comes into contact with the ground 18.

The invention claimed is:

1. A sports shoe having: an upper part configured to receive the foot of a wearer and a sole arrangement which is inclined so as to reduce in height in a forwards direction, wherein the sole arrangement includes: a compressible portion at a ground facing side of the sole arrangement which: is heelless in that it is provided with a recess such that there is no effective ground engagement in the region of the heel of the wearer when, in use, the wearer is at rest, and has a Shore A hardness value of less than 40, and is compressible to between 10% to 50% of its original thickness when subjected to a rapid, intermittent compressive force of between 600 to 6000 Newtons; the sole arrangement further including a rigid portion at an upper facing side of the sole arrangement: which has a Shore A hardness value of greater than 75, and includes a first part that is positioned so that, when the shoe is in use, the first part is situated just beneath the calcaneus, cuboid, fifth metatarsal bone and the fifth metatarsal phalangeal point of the foot of the wearer, the first part being substantially inflexible in the longitudinal direction of the shoe, and wherein the rigid portion includes a second part that is positioned so that, when the shoe is in use, the second part is situated just beneath the navicular bone, the first cuniform bone, the first, second and third metatarsal bones and the first, second and third metatarsal joints of the foot of the wearer, the second part being more flexible than the first part.

* * * * *